United States Patent [19]

Morris

[11] Patent Number: 4,765,224

[45] Date of Patent: Aug. 23, 1988

[54] AUTOMATIC RIFLE GAS SYSTEM

[76] Inventor: Michael C. Morris, Rte. 202 and County Line Rd., Chalfont, Pa. 18914

[21] Appl. No.: 897,150

[22] Filed: Aug. 15, 1986

[51] Int. Cl.[4] ..... F41D 5/04

[52] U.S. Cl. ..... 89/191.01; 89/185; 42/75.02

[58] Field of Search ..... 89/184, 185, 191.01

[56] References Cited

U.S. PATENT DOCUMENTS

| | | | |
|---|---|---|---|
| 799,884 | 9/1905 | Odkolek | 89/184 |
| 2,771,819 | 11/1956 | Morse et al. | 89/191.01 |
| 2,845,008 | 4/1957 | Atwood, Jr. | 89/193 |
| 2,903,809 | 2/1956 | Stoner | 42/50 |
| 2,951,424 | 9/1960 | Stoner | 89/191.01 |
| 3,035,495 | 5/1962 | Stoner | 89/33 |
| 3,045,555 | 12/1962 | Stoner | 89/142 |
| 3,087,270 | 4/1963 | Stoner | 42/50 |
| 3,090,150 | 5/1963 | Stoner | 42/71 |
| 3,246,567 | 6/1964 | Miller | 89/191 |
| 3,333,509 | 10/1965 | Muhlemann | 89/193 |
| 3,766,822 | 1/1972 | Sophinos | 89/14 |
| 3,988,964 | 11/1976 | Moore | 89/185 |
| 4,244,273 | 12/1978 | Langendorfer | 89/198 |
| 4,246,830 | 1/1981 | Krieger | 89/185 |

*Primary Examiner*—Stephen C. Bentley
*Attorney, Agent, or Firm*—Gerry J. Elman

[57] ABSTRACT

An M16-type automatic rifle is provided with an improved gas operating system. The tube extending forwardly from the bolt carrier key is of such length that it permanently mates with the aftwardly extending gas transfer tube as the bolt carrier key shuttles forward and aftward in operation. This arrangement minimizes fouling by combustion products from the firing of ammunition. Modifications to the gas transfer tube and barrel nut assembly accommodate the extended bolt carrier key tube and facilitate quick change of the barrel in the field with a standard tool.

37 Claims, 7 Drawing Sheets

AUTOMATIC RIFLE GAS SYSTEM

BACKGROUND OF THE INVENTION

1. Field of the Invention

The present invention relates to firearms, and more particularly to an improved automatic gas-operated rifle, of the type exemplified by the M16.

2. Brief Description of the Prior Art

The M16 automatic rifle is a standard of the American military. Originally known as the AR-15 of the ArmaLite Division of the Fairchild Engine and Airplane Company, it was designed by Eugene M. Stoner in 1957–1958. It is currently produced by Colt Industries. Modified versions of the M16, respectively the M16A1 and M16A2, are also currently in use by the U.S. armed services. As used herein, the term M16 includes the M16A1 and M16A2 versions. The term "M16-type" rifle or weapon includes all versions of the AR-15 and M16 ever produced, in production as well as in experimental versions and prototypes.

Although the M16 has long been one of the most widely used American military weapons, it is not without shortcomings. The M16 has a low tolerance for moisture. Military tests in 1958 at the Aberdeen Proving Ground and the Infantry Board, in 1959 at the Springfield Armory, and in 1962 again at Aberdeen indicated that the presence of water in the bore of the M16 constitutes a considerable safety hazard, including possible rupture of the barrel. See *The Great Rifle Controversy* by Edward C. Ezell at 181 (Harrisburg, Pa.: Stackpole Books 1984).

As stated in U.S. Army Field Manual FM 23-9 (1974) "Failure to remove water from the barrel may result in the weapon blowing up. If the weapon has been submerged in water, exposed to heavy rain and/or dew, or if there is any reason to believe there is excess moisture in the barrel, point the muzzle of the weapon toward the ground and pull the charging handle 2 to 3 inches to the rear, breaking the seal formed by the chambered round and allowing the water to drain out of the barrel."

Combat use in the damp climate of Vietnam graphically demonstrated this shortcoming, and pointed up the need for frequent cleaning of the M16 to avoid fouling and jamming. Yet in the heat of battle, one of the first "nonessentials" to be discarded by a combat soldier is his weapon cleaning kit.

SUMMARY OF THE INVENTION

In accordance with the present invention, an M16 automatic rifle or the like is provided with an improved gas operating system. The tube extending forwardly from the bolt carrier key is of such length that it permanently mates with the aftwardly extending gas transfer tube as the bolt carrier key shuttles frontward and aftward in operation.

In view of the foregoing, it is a principal object of the present invention to provide an M16-type rifle having generally increased reliability, and for example, which is capable of safe operation in damp surroundings and even when subjected to rain and to temporary immersion, as when crossing a river, before firing.

Another principal object of the present invention is to provide an M16-type rifle which is capable of firing an extended number of rounds between cleanings without fouling.

Another principal object of the present invention is to provide a method for increasing the reliability of existing M16-type rifles through retrofitting in accordance with the present invention, using a minimum of retooling to effect maximum improvement in performance.

It is a further object of the present invention to provide an M16-type rifle having a barrel which can be removed and changed in the field, with a standard barrel nut wrench rather than with specialized armorer's tools.

It is a further object of the present invention to provide an M16-type rifle in which the gas transfer tube and the bolt carrier key are less likely to become mismated during operation or cleaning.

Other objects and a more complete understanding of the invention may be had by referring to the following specification and claims taken in conjunction with the accompanying drawings.

DETAILED DESCRIPTION OF THE INVENTION

Figure 1:
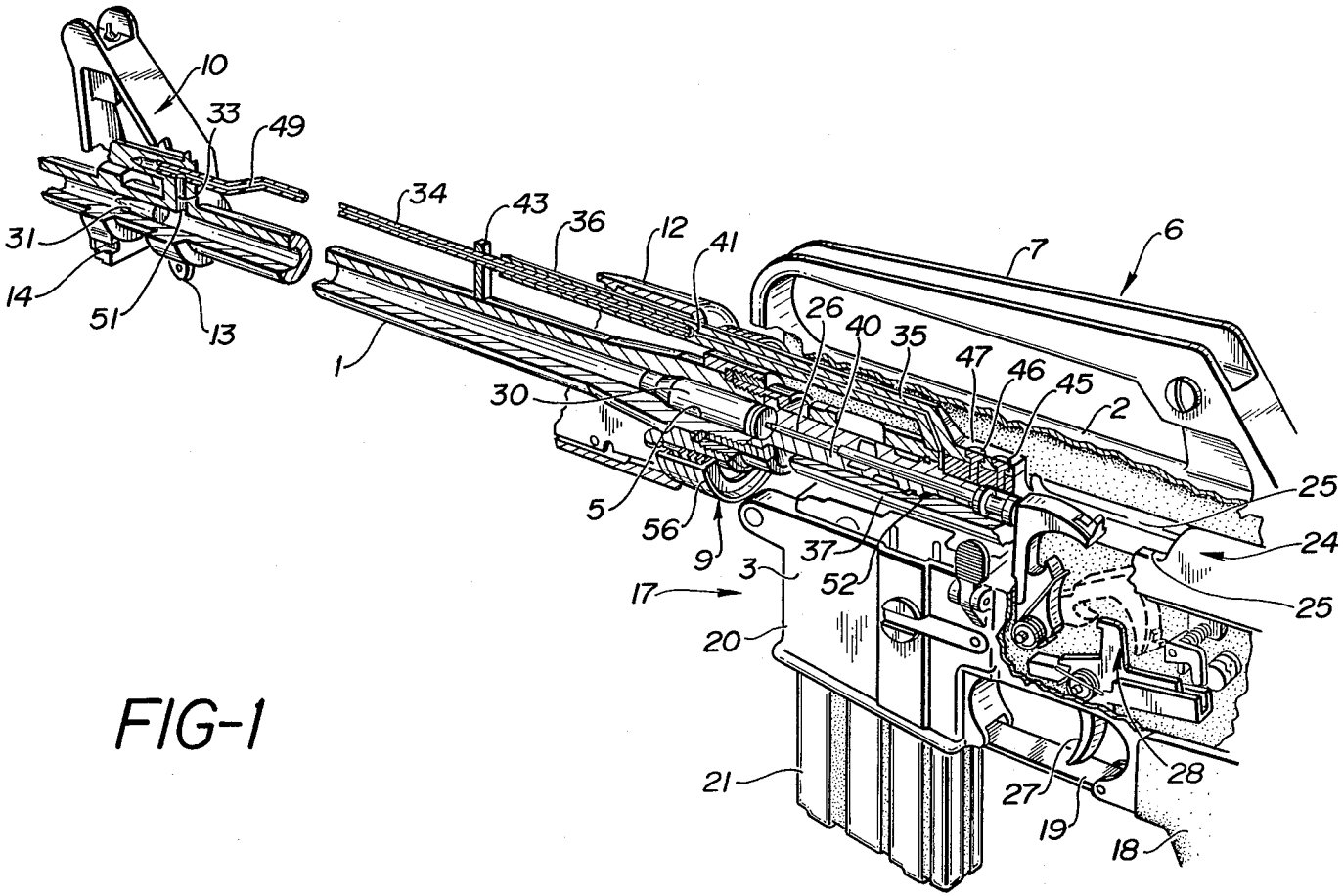
FIG. 1 is a fragmentary oblique side elevational view of a conventional M16 rifle modified in accordance with the present invention, with the fore direction, in which the barrel points, being obliquely to the left.

An automatic rifle in accordance with the present invention is shown in FIG. 1 with the barrel 1 pointing obliquely generally leftwards. Such a rifle includes all of the elements of a conventional M16. An upper receiver 2 and lower receiver 3 together form an enclosure which defines the receiver 4. Within the receiver 4, cartridges are automatically fed, into a chamber 5 formed in the aft end of the barrel 1, fired and ejected by the cycling action of the weapon.

Secured to the upper receiver 2 are additional elements which collectively comprise an upper receiver group 6. These elements include a carrying handle 7 and rear sight 8 that are conventionally formed integrally with and extending from the upper receiver 2, a barrel 1, a front sight assembly 10 secured towards the fore end of the barrel 1, and a flash suppressor 11 secured to the front of the barrel 1. The barrel 1 is detachably secured to a screw-threaded barrel port 54 at the front of the the upper receiver 2 by means of a barrel nut assembly 9, which cooperates with a flange 57 on the barrel 1. The barrel nut assembly 9 comprises the parts, as shown in FIGS. 7, 8, 10 and 11, from fore to aft: a barrel nut 44, a delta ring 56, a delta ring spring 39, and a delta ring lock washer 38.

Optionally a two-part detachable handguard 12 surrounds the barrel 1, and a sling swivel 13 and bayonet stud 14 may depend from the bottom of the front sight assembly 10. A charging handle 15 and a forward assist assembly 16 may each conventionally extend from and into the upper receiver 2.

Secured to the lower receiver 3 are additional elements which collectively comprise a lower receiver group 17. Depending from and conventionally formed integrally with the lower receiver 3 are a handgrip 18 and a trigger guard 19, as well as a magazine mount 20 having a downwardly opening port adapted to detachably receive interchangeable magazines 21 for feeding successive rounds of ammunition up into the chamber 54 by spring action. Conventionally a stock 22 is secured to the rear of the lower receiver 3, and a sling swivel 13 may depend from the stock 22 and barrel 1.

Within the receiver 4 are a bolt carrier assembly 24 slidably mounted on a pair of rails 25 in the upper receiver 2 for fore and aft reciprocation. As its name implies, the bolt carrier 37 carries a bolt 40, through which a firing pin 26 extends. A trigger 27 extends within the trigger guard 19 to control the action of a conventional M16 trigger mechanism 28 within the lower receiver 3. An extractor assembly 29 ejects the spent shell 30 at the appropriate time in the firing cycle.

Figure 2:
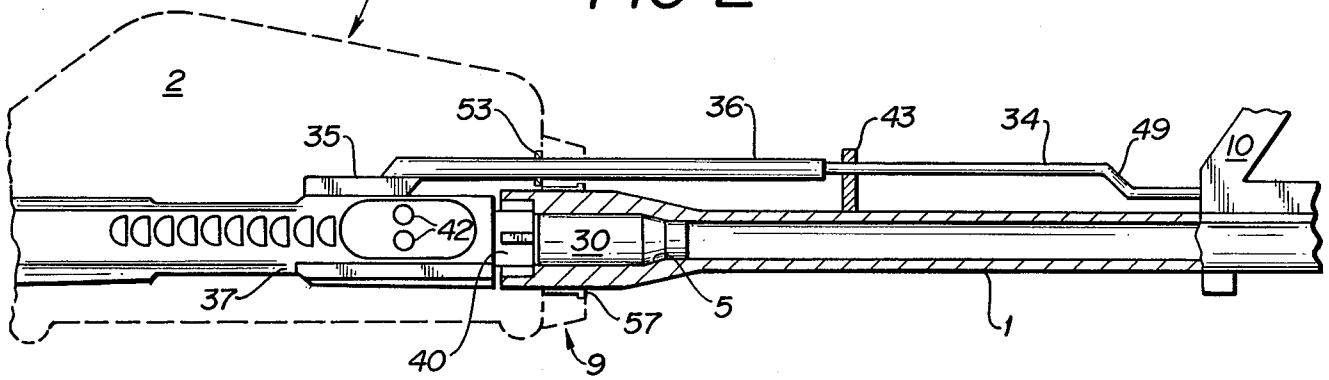
FIG. 2 is a fragmentary side elevational view, in partial cross section through the barrel, of a rifle in accordance with the present invention, immediately after firing a cartridge, wherein the bolt carrier is in a forward position, fore being to the right side of the figure and aft being to the left.
Figure 3:
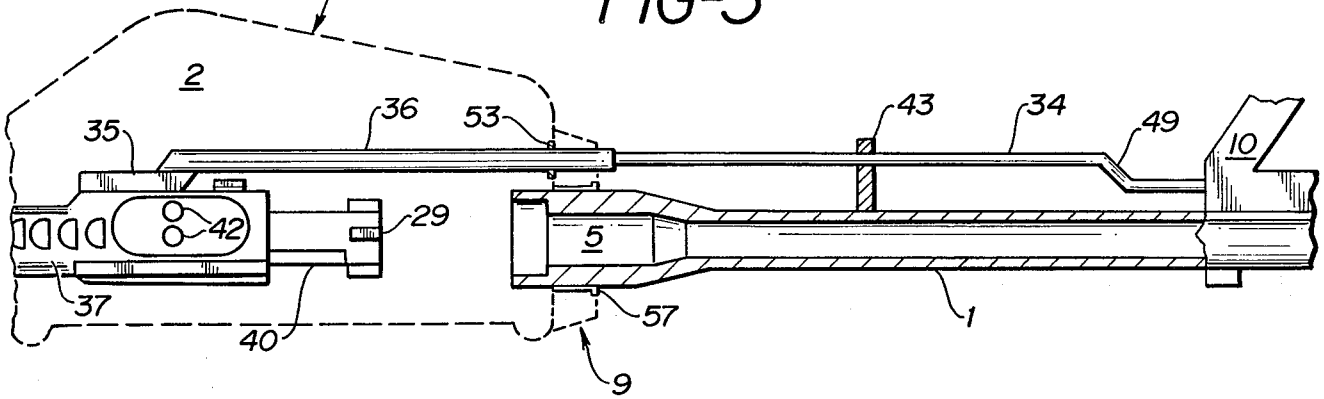
FIG. 3 shows a rifle in accordance with the present invention in the view of FIG. 2, with the bolt carrier in an aftwards position (to the left in this view), after the cartridge has been ejected.
Figure 4:
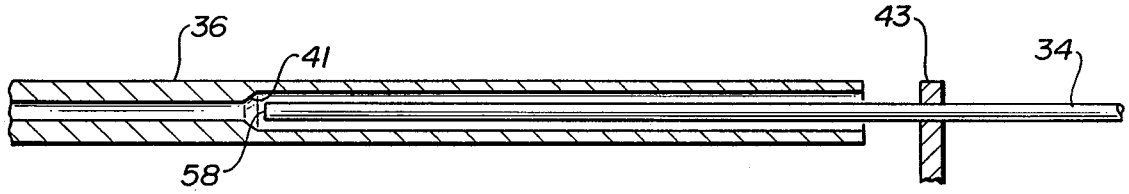
FIG. 4 is a side elevational view showing a portion of the gas system of the present invention in the position shown in FIG. 2, illustrating a portion of the key tube extending from the bolt carrier key in cross section and a portion of the gas transfer tube.
Figure 5:
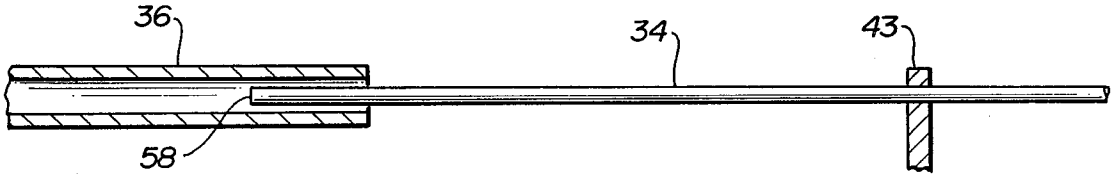
FIG. 5 is a side elevational view similar to FIG. 4 showing a portion of the gas system of the present invention in the position shown in FIG. 3.

The automatic cycling of an M16-type weapon is conventionally powered by providing means for bleeding off a portion of the gas pressure in the barrel 1 behind the projectile 31 and feeding it back into the receiver 4. This is accomplished by providing an opening 51 in the fore end of the barrel 1 (generally a circular hole perpendicular to the bore of the barrel) which communicates only with a gas port 33 that extends through the front sight assembly 10 and directs the gas pressure entirely into an aftward-extending gas transfer tube 34. (In FIG. 2, the aft direction is to the left.)

In conventional M16-type rifles, the gas transfer tube 34 extends through the upper receiver 2 into the receiver 4. A bolt carrier key 35 is conventionally provided in the receiver 4 to shuttle fore and aft, alternately mating with the aft end 58 of the gas transfer tube 34 when the bolt carrier key 35 is in its forward position, and demating therefrom when the bolt carrier key 35 is in its aftward position.

Conventionally, a buffer assembly (not shown) including a spiral spring, a recoil buffer and an guidance tube, is positioned aft of the bolt carrier. The spring becomes tensioned when the bolt carrier is driven aftward, and it provides force to drive the bolt carrier forwardly by releasing such tension.

This conventional operation of the gas system of the M16 gives rise to certain inherent deficiencies stated above. For example, it is recommended that the weapon be cleaned each time after firing only some 600 to 800 rounds. If such maintenance is not performed, the weapon is subject to jamming or other malfunction, which can be deadly in combat. Nevertheless, in the heat of battle, it is not always possible to take the time to do such necessary cleaning. Furthermore, deficiencies in the operation of the weapon in wet condition are well documented.

In accordance with the present invention, I have discovered that these significant deficiencies may be substantially ameliorated, and other benefits may be obtained, by performing a series of deceptively simple modifications of the gas operating system. In a most basic embodiment of my invention, the bolt carrier key 35 is provided with an extended key tube 36 which is long enough to continue in mating relationship with the gas transfer tube 34 throughout its entire range of fore and aft travel. One benefit provided by this change is that of preventing smoky combustion products from being poured directly into the receiver 4.

In the conventional M16-type rifle, such combustion products are conventionally directed into the receiver 4 as the bolt carrier key 35 de-mates from the gas transfer tube 34 with each round fired. At that point, there is nothing to prevent this hot, sooty material from fouling the firing mechanism including firing pin 26 and trigger mechanism 28, and the extractor assembly 29.

In accordance with the present invention, the gas transfer tube 34 is preferably supported in its position with respect to the barrel by a centering clamp 43. The centering clamp 43 is located forward of the frontmost end of the key tube 36 when the key tube 36 is in the most forward position of its reciprocation.

The tube port 50 in the upper receiver 2 is enlarged to accomodate the key tube 36, and a grommet 53, preferably lined with metal wool or spongy material is preferably placed in the tube port 50 to surround the key tube 36 to provide a slidable seal for the rapidly reciprocating key tube 36, while keeping its exterior from fouling and jamming at the tube port 50.

Preferably the length of the key tube 36 is between about 7.25 inch and 8.0 inch and the distance between the front of the receiver 4 and the aft end 58 of the gas transfer tube 34 is between about 0.75 inch and 1.25 inch.

The optimal clearance between the key tube 36 and the gas transfer tube 34 during the reciprocation of the key tube 36 is provided when the difference between the internal bore of the key tube 36 and the external diameter of the gas transfer tube 34 is between about 0.0125 inch and about 0.025 inch.

Further in accordance with the present invention, the extended key tube 36 has a neck 41 in its interior surface by which the inner diameter of the key tube 36 decreases from a diameter which is sufficient to accomodate the outer surface of the gas transfer tube 34 in sliding relation with the interior surface of the key tube 36. In an M16-type weapon, this diameter of the key tube 36 forward of the neck 41 may be between about 0.190 inches and 0.205 inches, and preferably about 0.201 inches. Aftward of the neck, the interior of the key tube tapers rapidly to a smaller diameter, which may be between 0.117 inches and 0.129 inches and is preferably about 0.125 inches.

Figure 6:
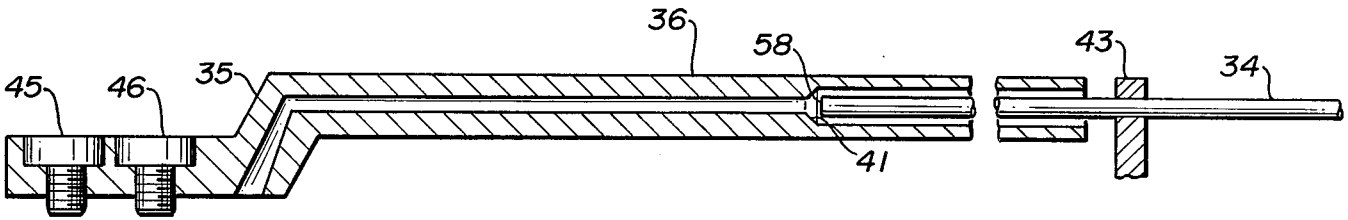
FIG. 6 is a side elevational view of the bolt carrier key, the key tube, and a portion of the gas transfer tube with fore being to the right side of the drawing. In this illustration, the bolt carrier is in its most forward position.
Figure 9:
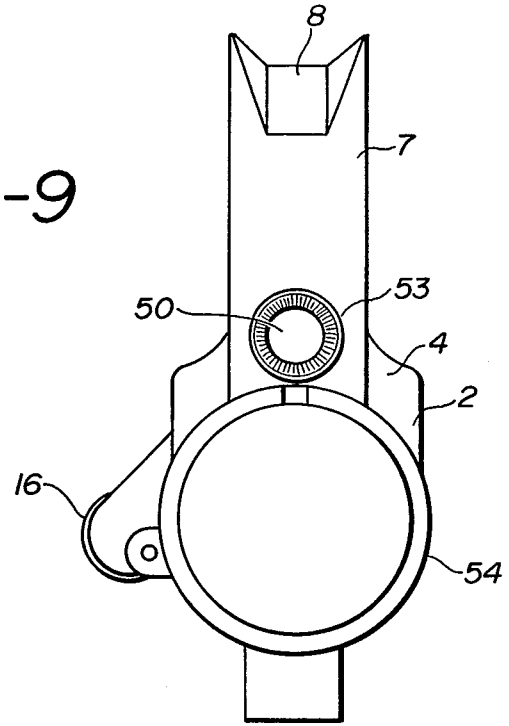
FIG. 9 is a front elevational view taken along the line 9—9 in FIG. 8.
Figure 7:
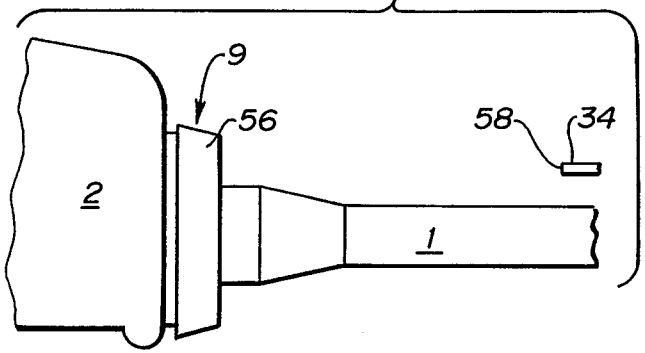
FIG. 7 shows a side elevational view of the connection between the barrel and the receiver, with fore being to the right side of the drawing.
Figure 8:
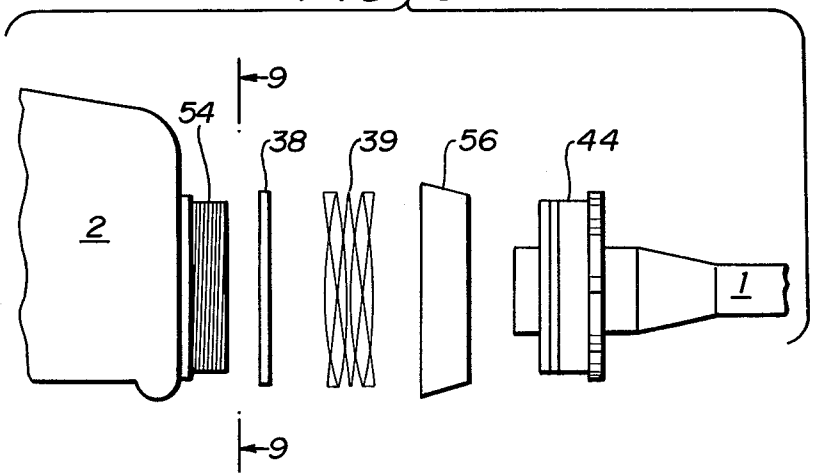
FIG. 8 provides a disassembled, or exploded, view of the parts of the assembly shown in FIG. 7.

In FIG. 6, the key tube 36 is in its most forward position. In this position, the neck 41 just meets the aft end 58 of the gas transfer tube 34. The smaller interior area of the key tube 36 aft of this neck 41 provides for greater gas pressure within the key tube 36 than would exist if the key tube 36 were not so configured. The surface of the neck 41 provides for a greater backward force on the key tube 36 as the gas exerts pressure on it, thereby providing for a greater initial force on the key tube 36 and bolt carrier 37. This high initial force delocks the bolt 40 of the bolt carrier 37 and overcomes the initial resistance of the bolt carrier 37 and sets it in motion aftwardly. This force quickly decreases as the key tube 36 moves aft exposing the greater inner diameter of the key tube 36. This greater diameter provides for a greater volume for the gas to fill. With the greater volume, the gas pressure decreases.

In accordance with the present invention, once the projectile 31 passes the gas port 33, a portion of the gas resulting from the explosion of the gunpowder in the cartridge 5 travels through the gas port 33 into the gas transfer tube 34 as in the conventional M16. It travels through the gas transfer tube 34, whereby it is directed into the extended key tube 36 of the present invention.

The gas continues to travel through the key tube 36 into the bolt carrier key 35 and subsequently into the cylinder 52 between the bolt carrier 37 and the bolt 40. The gas pressure forces the bolt 40 forward, delocking the chambered cartridge and moving the bolt carrier 37 aftward. As the bolt carrier 37 moves aftward, the bolt carrier gas ports 42 are exposed and the gas escapes.

Although a bolt carrier key 35 having the extended key tube 36 of the present invention obviously has greater mass and thus greater intertia than the conventional bolt carrier key, I have found that it nevertheless can be made to function not only as well as the conventional bolt carrier key, but that it also provides certain advantages mentioned above. In particular, a rifle in accordance with the present invention is capable of firing at least 2000 to 2500 rounds before it becomes as dirty as a conventional M16 after 600 to 800 rounds and should be cleaned.

The aftmost portion of the the gas transfer tube 34 must be straight and parallel to the axis of the barrel 1 for a distance sufficient to accommodate the reciprocating motion of the bolt carrier key tube 36. In an M16-type weapon this distance is about 4.5 inches at a minimum.

Figure 10:
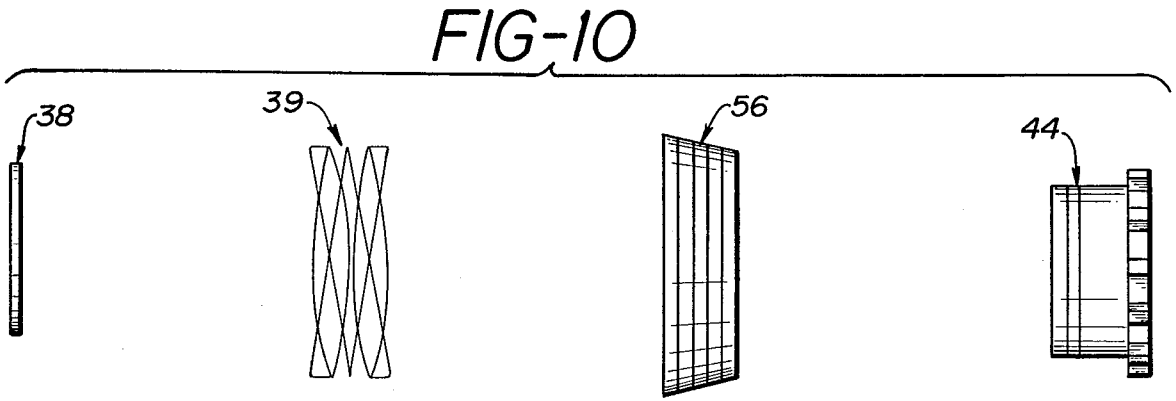
FIG. 10 is a side elevational view of the various parts of the assembly shown in FIG. 8.
Figure 11:
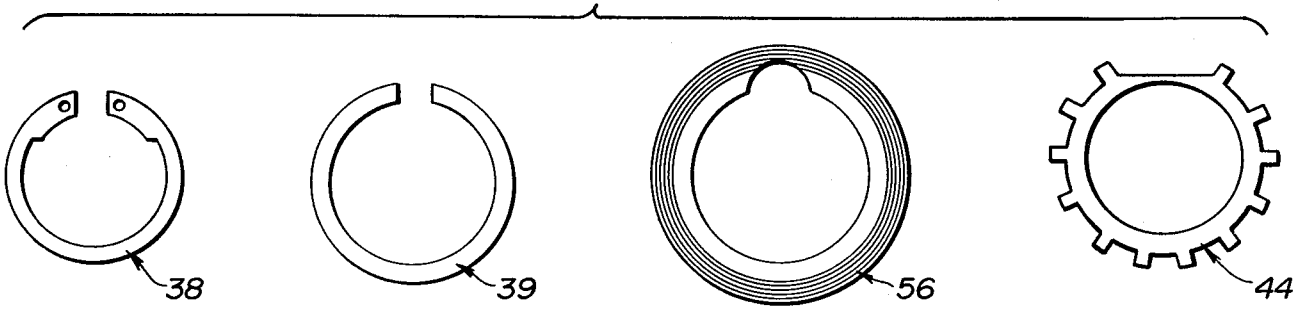
FIG. 11 is a front elevational view of each of the parts shown in FIG. 10.
Figure 12:
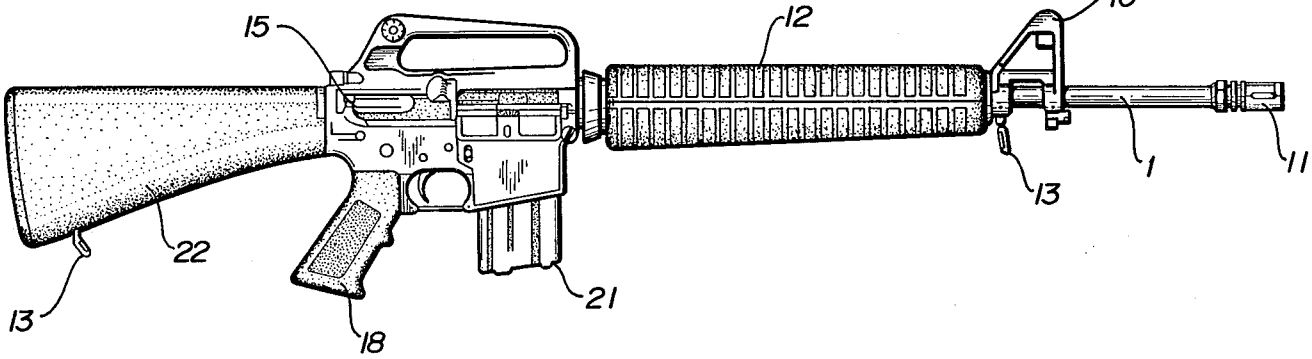
FIG. 12 is a side elevational view of a conventional M16 rifle modified in accordance with the present invention.

As mentioned previously, the barrel 1 is secured to the receiver 4 at a screw-threaded barrel port 54 thereon by a barrel nut 44 which cooperates with a barrel flange 57 on the barrel 1. The barrel nut 44 and cooperating parts together comprise the barrel nut assembly 9. As shown in FIGS. 10 and 11, in accordance with the present invention, each of the parts of the barrel nut assembly 9, namely a barrel nut 44, a delta ring 56, a delta ring spring 39, and a delta ring lock washer 38, has a shape modified from that of the corresponding part of a conventional M16-type weapon so as to accommodate the additional diameter of the key tube 36 passing therethrough.

An advantage of the present weapon over a conventional M16 is that the barrel can be readily removed using a conventional barrel nut wrench (not shown) rather than specialized armorer's tools as is conventionally required. This is because the gas transfer tube 34 of the present invention terminates fore of barrel nut 44 and therefore does not have to be removed to permit disconnection of the barrel 1 from the barrel port 54.

To remove the barrel 1, one first removes any handguards 12 and separates the lower receiver 3 from the upper receiver 2, and then slides the bolt carrier 37 aftwards, removing it from the weapon. One then applies a conventional barrel nut wrench (not shown) to turn the barrel nut 44 counterclockwise until is free of the barrel port 54. This allows the barrel 1 to be separated from the receiver 4, the other parts of the barrel nut assembly 9 remaining with the barrel nut 44 on the barrel 1. A new barrel 1 and barrel nut assembly 9 can then be installed by reversing the aforementioned steps. An M16-type rifle having a conventional gas system may be modified so that its functioning is significantly improved in accordance with the present invention as follows. The existing gas transfer tube (not shown) is replaced with a gas transfer tube 34 in accordance with the present invention. The existing bolt carrier key (not shown) can be replaced by a new bolt carrier key 35 with an extended key tube 36 in accordance with the present invention. The tube port 50 of the upper receiver 2 should be enlarged to accomodate the key tube 36 which reciprocates through it. Optionally a grommet 53 lined with metal wool or spongy material is installed in the tube port 50. The parts forming the connection between the barrel 1 and the upper receiver 2 are modified as shown in FIGS. 7 to 11 to accomodate the increased diameter of the key tube 36 as compared with the gas transfer tube 34 which previously passed above them.

A supporting clamp 43 may be welded or preferably detachably secured, as by a spring clamp, to the barrel 1 and connected to the gas transfer tube 34 to maintain the two in spaced relationship. The supporting clamp 43 must of course be be located forward of the frontmost end of the key tube 36 when the key tube 36 is in the most forward position of its reciprocation.

If it is not desired to replace the existing gas transfer tube, it can be can be shortened and bent to form the gas transfer tube 34 of the present invention. As an alternative to replacing the existing bolt carrier key (not shown), the key tube can be extended by welding or otherwise securing an extention to the existing bolt carrier key to form the bolt carrier key 35 of the present invention with extended key tube 36. However, such extension of the bolt carrier key may be less preferable since the inner diameter of the existing key tube may differ from the most desirable diameter of the key tube 36 of the present invention.

As mentioned above, the barrel nut assembly 9, which comprises a barrel nut 44, a delta ring 56, a delta ring spring 39, and a delta ring lock washer 38, has a shape modified from that of the corresponding part of a conventional M16-type weapon so as to accommodate the additional diameter of the key tube 36 passing therethrough. Accordingly, to retrofit an existing M16, one may desirably machine the existing parts of the barrel nut assembly 9 to the shapes shown in FIGS. 10 and 11. Alternatively, new parts may be substituted for the original ones.

Having thus described the invention, what it is desired to claim and thereby protect by Letters Patent is:

1. A rifle comprising an upper receiver group, a lower receiver group, and a bolt carrier group, said upper receiver group further comprising a barrel, an upper receiver, a cartridge extractor mechanism, and a gas transfer tube communicating with the barrel for the transfer of propellant gas pressure therefrom and extending aftwardly from said point of communication with the barrel towards the upper receiver, said gas transfer tube having an aftmost portion parallel to said barrel;

said lower receiver group further comprising a trigger mechanism, and a lower receiver adapted to be secured to said upper receiver and together therewith defining a receiver, said lower receiver being adapted to receive an interchangeable magazine adapted to contain a plurality of ammunition cartridges and to feed them individually into said chamber, said bolt carrier group comprising a bolt, a firing mechanism associated with and carried by said bolt, an extracting mechanism for extracting spent shells, and a bolt carrier slidably mounted within the receiver for forward and backward reciprocation through a cycle of chambering, firing and extracting a round of ammunition, said bolt carrier having affixed thereto a bolt carrier key, said bolt carrier key having a key tube extending therefrom forwardly along the axis of said aftmost portion of the gas transfer tube, said key tube extending through a port in the upper receiver, said port being of a size to provide sliding clearance for said key tube, said key tube having an internal bore of a diameter sufficient to provide sliding clearance with the external surface of said aftmost portion of the gas transfer tube, whereby the key tube slidably engages in mating relationship with the gas transfer tube during the entire firing cycle.

2. The rifle of claim 1, wherein the aft end of the gas transfer tube is fore of the port in the upper receiver.

3. The rifle of claim 1, wherein the difference between the internal bore of the key tube and the external diameter of the aftmost portion of the gas transfer tube is between about 0.0125 inch and about 0.025 inch.

4. The rifle of claim 1, wherein the length of the key tube is between about 7.25 inch and about 8.0 inch and the distance between the front of the receiver and the aft end of the gas transfer tube is between about 0.75 inch and about 1.25 inch.

5. The rifle of claim 2, further comprising a centering clamp detachably affixed to the barrel and detachably affixed to the gas transfer tube at a position fore of the point of forwardmost travel of the front end of the key tube.

6. The rifle of claim 2, further comprising a grommet within said tube port, said grommet having a lining of metal wool or spongy metal of an inner diameter substantially the same as the outer diameter of the key tube.

7. The rifle of claim 1, wherein said upper receiver group further comprises means for detachably securing said barrel to said upper receiver without the use of specialized armorer's tools.

8. The rifle of claim 7, wherein said means for detachably securing said barrel to said upper receiver comprises a screw-threaded barrel port on said upper receiver and a barrel nut assembly comprising a screw-threaded barrel nut adapted to mate with said barrel port, said barrel nut being configured such that the key tube can pass outside it.

9. The rifle of claim 8, wherein said barrel nut assembly further comprises a delta ring, a delta ring spring, and a delta ring lock washer, each of which is configured so that the key tube can pass therethrough.

10. In an M16-type rifle having a bolt carrier key, a gas transfer tube, and an upper receiver, an improved gas system comprising:

an improved bolt carrier key having a key tube extending therefrom forwardly along the axis of said aftmost portion of the gas transfer tube, said key tube extending through a port in the upper receiver, said port being of a size to provide sliding clearance for said key tube, said key tube having an internal bore of a diameter sufficient to provide sliding clearance with the external surface of said aftmost portion of the gas transfer tube, whereby the key tube slidably engages in mating relationship with the gas transfer tube during the entire firing cycle.

11. The rifle of claim 10, wherein the aft end of the gas transfer tube is fore of the port in the upper receiver.

12. The rifle of claim 11, further comprising a centering clamp detachably affixed to the barrel and detachably affixed to the gas transfer tube at a position fore of the point of forwardmost travel of the front end of the key tube.

13. The rifle of claim 10, wherein the difference between the internal bore of the key tube and the external diameter of the aftmost portion of the gas transfer tube is between about 0.0125 inch and about 0.025 inch.

14. The rifle of claim 10, wherein the length of the key tube is between about 7.25 inch and about 8.0 inch and the distance between the front of the receiver and the aft end of the gas transfer tube is between about 0.75 inch and about 1.25 inch.

15. A method of modifying an M16-type rifle for improved performance comprising the steps of:

providing an M16-type rifle having a conventional gas system comprising a bolt carrier key and a gas transfer tube, said gas transfer tube communicating with a barrel through a gas port in said barrel and a front sight assembly contiguous to said barrel, said gas transfer tube extending through a tube port in an upper receiver, said upper receiver being detachably secured to the barrel by a barrel nut assembly comprising a screw-threaded barrel nut;

providing a bolt carrier key having a key tube extending forwardly therefrom of a length and diameter sufficient to slidably mate with the gas transfer tube throughout an entire firing cycle and substituting it for the original bolt carrier key;

providing a gas transfer tube which has an aft portion that is coaxial with said key tube along a length sufficient to slidably mate with the key tube throughout an entire firing cycle, said gas transfer tube terminating fore of the upper receiver;

enlarging the tube port in the upper receiver to a size sufficient to slidably admit the key tube extending forwardly therethrough, and providing a barrel nut assembly having each of its elements shaped to slidably admit the key tube extending forwardly therethrough, whereby the rifle is thereafter capable of firing an increased number of rounds between necessary cleanings and is capable of having its barrel interchanged in the field by unscrewing the barrel nut with the use of a standard barrel nut wrench.

16. The method of claim 15, wherein the gas transfer tube is provided by bending the original gas transfer tube of said M16-type rifle so that its aftmost portion is parallel to said barrel for a length of at least about 4.5 inches and shortening said gas transfer tube to a length such that the distance between the front of the receiver and the aft end of the gas transfer tube is between about 0.75 inch and about 1.25 inch.

17. The method of claim 15, wherein the gas transfer tube is provided in substitution for the original gas transfer tube of said M16-type rifle.

18. The method of claim 15, wherein the tube port is enlarged by reaming a generally circular hole in said upper receiver.

19. The method of claim 18, further comprising the step of interposing a grommet within said tube port after enlargement, said grommet having a lining of metal wool or spongy metal of an inner diameter substantially the same as the outer diameter of the key tube.

20. The method of claim 15, wherein the step of providing a barrel nut assembly having each of its elements shaped to slidably admit the key tube extending forwardly therethrough, is performed by modifying the shape of the preexisting elements of the barrel nut assembly.

21. The method of claim 20, wherein the barrel nut assembly comprises a barrel nut, a delta ring, a delta ring spring, and a delta ring lock washer, and wherein the elements of the barrel nut assembly are modified by machining.

22. The method of claim 15, further comprising the step of securing the gas transfer tube to the barrel at a location aft of the front sight assembly and fore of the end of the key tube at its point of most forward extension during the firing cycle, whereby the portion of the gas transfer tube which is surrounded by the key tube at its said point of most forward extension is secured parallel to the barrel and coaxial with said key tube.

23. The method of claim 22, wherein the gas transfer tube is detachably secured to the barrel with a spring clamp.

24. An M16-type rifle modified in accordance with claim 15.

25. An M16-type rifle modified in accordance with claim 16.

26. An M16-type rifle modified in accordance with claim 17.

27. An M16-type rifle modified in accordance with claim 18.

28. An M16-type rifle modified in accordance with claim 19.

29. An M16-type rifle modified in accordance with claim 20.

30. An M16-type rifle modified in accordance with claim 21.

31. An M16-type rifle modified in accordance with claim 22.

32. An M16-type rifle modified in accordance with claim 23.

33. An improved M16-type rifle comprising an enclosure defining a receiver, a barrel communicating with the receiver, gas-driven reciprocating means for automatically chambering, firing and extracting successive rounds of ammunition fed from magazine means, and means for transferring gas pressure from within the barrel to said reciprocating means;

wherein said gas-driven reciprocating means comprises a bolt carrier key, said bolt carrier key having a key tube extending therefrom forwardly through a port in the enclosure, said port being of a size to provide sliding clearance for said key tube, and wherein said means for transferring gas pressure comprises a gas transfer tube having an aftmost portion coaxial with said key tube, said key tube having an internal bore of a diameter sufficient to provide sliding clearance with the external surface of said aftmost portion of the gas transfer tube, whereby the key tube slidably engages in mating relationship with the gas transfer tube during the entire firing cycle.

34. The rifle of claim 33, wherein the difference between the internal bore of the key tube and the external diameter of the aftmost portion of the gas transfer tube is between about 0.0125 inch and about 0.025 inch.

35. The rifle of claim 33, wherein the length of the key tube is between about 7.25 inch and about 8.0 inch and the distance between the front of the enclosure and the aft end of the gas transfer tube is between about 0.75 inch and about 1.25 inch.

36. The rifle of claim 33, further comprising a centering clamp detachably affixed to the barrel and detachably affixed to the gas transfer tube at a position fore of the point of forwardmost travel of the front end of the key tube.

37. The rifle of claim 33, further comprising a grommet within said port, said grommet having a lining of metal wool or spongy metal of an inner diameter substantially the same as the outer diameter of the key tube.

* * * * *